US005730297A

United States Patent [19]

Lower et al.

[11] Patent Number: 5,730,297

[45] Date of Patent: Mar. 24, 1998

[54] SCREENING MACHINE WITH IMPROVED BASE FORCE REDUCTION

[75] Inventors: William E. Lower, Cincinnati; Stephen C. Mitchell, West Chester, both of Ohio

[73] Assignee: Rotex, Inc., Cincinnati, Ohio

[21] Appl. No.: 565,628

[22] Filed: Nov. 27, 1995

[51] Int. Cl.[6] ..... B07B 1/38

[52] U.S. Cl. ..... 209/332; 198/760

[58] Field of Search ..... 209/332, 326, 209/365.4, 331, 365.1, 325, 366; 198/760, 761

[56] References Cited

U.S. PATENT DOCUMENTS

| | | | |
|---|---|---|---|
| 1,668,984 | 5/1928 | Simpson | 74/61 |
| 2,120,032 | 6/1938 | Mess et al. | 209/325 |
| 3,703,236 | 11/1972 | Spurlin et al. | 209/326 |
| 4,121,708 | 10/1978 | Benson | 198/766 |
| 4,167,478 | 9/1979 | Salete | 209/331 |
| 4,287,056 | 9/1981 | Dumbaugh et al. | 209/332 |
| 4,492,629 | 1/1985 | Dumbaugh | 209/332 |
| 4,813,532 | 3/1989 | Harper | 198/760 |
| 4,961,491 | 10/1990 | Falconer | 198/761 |
| 5,037,535 | 8/1991 | Bruderlein | 209/310 |
| 5,301,814 | 4/1994 | Lower et al. | 209/326 |

OTHER PUBLICATIONS

1992 Rotex, Inc. Screener Catalog 209.

*Primary Examiner*—Kenneth Noland
*Attorney, Agent, or Firm*—Wood, Herron & Evans, L.L.P.

[57] ABSTRACT

A screening machine of the moving base type has an oscillating force reducer and a single counterbalance drive, with the weight of the drive counterbalance sized to underbalance the longitudinal reaction force exerted by the deck on the drive shaft, but to substantially overbalance the lateral reaction force exerted by the deck on the drive shaft. The weight of the force reducer, the spring constant of the spring which oscillates the force reducer, and overall cost are surprisingly reduced.

12 Claims, 3 Drawing Sheets

SCREENING MACHINE WITH IMPROVED BASE FORCE REDUCTION

FIELD OF THE INVENTION

This invention relates to screening machines of the moving base type, and further to a screening machine having improved structure for reducing the effect of reaction forces exerted on the moving base by operation of the drive.

Background

In a screening machine of the moving base type, the screen deck is operated by a drive which imparts a screening motion to it. The drive is supported on the movable base, which in turn is usually hung on cables from a fixed support or is sometimes isolated on shear (i.e., elastically flexible block) or other resilient mounts. The drive may for instance rotate an eccentric having a shaft connected to gyrate the head end of the deck in a circular motion. The force of the shaft on the deck produces an equal but opposite reaction force applied by the deck to the shaft. Because the drive is connected between the deck and the base, the reaction force is transferred from the deck to the drive shaft, to the base and tends to move the base in the opposite direction from the deck. This has the undesirable affect of reducing the net motion of the deck relative to the fixed support, i.e., relative to ground, and thereby reducing the screening rate. Typically the drive has a counterbalance in order to offset this reaction force and thereby reduce the force it transmits to the base. This has the desirable effect of increasing the movement of the deck relative to the ground, and thereby improving the screening rate.

The supported (movable) components of the machine (i.e., the movable base, the deck, and the drive and components that move with them) have different moments of inertia in the longitudinal and lateral directions, because the drive is positioned on the machine centerline in the longitudinal direction but is significantly offset from the centerline in the lateral direction. As a result, the extent of base lateral movement may differ from its longitudinal movement. In order to minimize movements of the base in both directions, it was long the practice, at least for large movable base machines, to use a drive having a so-called "double" counterbalance. Such drives have two counterbalances which counter-rotate so that their actions alternately add to and subtract from one another, producing different reaction forces on the base in different directions. This minimizes movement of the base relative to ground both laterally and longitudinally. However, double counterbalance drives are relatively complex, heavy and expensive.

U.S. Pat. No. 5,301,814, issued Apr. 12, 1994, assigned to the assignee of this application, teaches that instead of a double counterbalance, a single counterbalance drive can be used for a moving base machine by mounting to the base a "force reducer" comprising an oscillatable spring/mass system which is tuned so that motion of the base produces amplified oscillation of the mass in at least one of the directions in which the base moves in its reaction to the operation of the drive. The patent discloses a counterbalance weight sized to produce a longitudinal reaction force on the shaft of the drive which is substantially equal to and opposite from the force the screen deck exerts on the drive shaft. This effectively cancels the longitudinal reaction force that would otherwise act on the base, and thereby maximizes the longitudinal movement of the deck relative to ground. (It is the longitudinal deck movement which conveys the particles being screened along the inclined deck from the feed port toward the tail.) The springs and mass of the force reducer are sized to offset the resulting large reaction force on the base in the lateral direction. Because the movement of the base, relative to ground, in the longitudinal direction is greatly reduced, movement of the deck relative to ground is correspondingly increased, and screening efficiency is thereby improved.

In its preferred embodiment, the force reducer of the '814 patent is a weight (mass) suspended from the base by leaf springs adjacent the point at which a rotary eccentric drive is journaled in the screen deck. The springs are vertical stacks of springs in the form of fiberglass spring sheets. The mass is a horizontal stack of steel plates, each of which may weigh many hundred pounds depending on the swung weight. ("Swung weight" is the weight of the components to which the screening motion is imparted, i.e., the screen deck and top cover if any, not including the base, the drive, or the force reducer.) The springs are preferably oriented so that the mass will oscillate in the lateral direction in response to motion of the base. The force reducer is "tuned" by proper calculated selection of the weight of the mass and the spring constant, so that in use the mass will resonate laterally at a frequency preferably just above the operating frequency of the drive.

As explained in the '814 patent, use of a force reducer provides several advantages. It makes possible the use of a singular counterbalance drive rather than the double counterbalance drive normally needed for a large screening machine having a movable base. A single counterbalance drive is less complex, has fewer moving parts, is less likely to require maintenance or repair, and is less expensive than a double counterbalance.

However, it has been found in practice that the addition of such a force reducer to a large screening machine having a single counterbalance drive, required an undesirably heavy mass in the force reducer to produce the desired oscillation force. It also required an expensive assembly of many fiberglass sheet springs to provide the necessary spring constant to oscillate that mass. These factors somewhat offset the overall efficiency and savings resulting from use of a single counterbalance instead of a double counterbalance drive. Thus there has been a need for a way to reduce the weight and expense of the machine and to use the structure more efficiently.

Brief Description of the Invention

Surprisingly, it has now been found that by appropriately setting the weight of the counterbalance, the weight of the force reducer and the number and size (i.e., the spring constant) of the springs which oscillate the force reducer can be substantially reduced from what they had previously been in machines having a force reducer with a single counterbalance drive, and the cost of both the force reducer and the drive can be significantly reduced, yet the screening efficiency will still equal that of a more expensive double counterbalanced machine.

This is done by providing a counterbalance weight which in use produces a counterbalance force that significantly underbalances the longitudinal reaction force of the base on the drive shaft but also substantially overbalances the lateral reaction force of the base on the drive shaft. The longitudinal reaction force should preferably be underbalanced by about 10–50%; that is, only about 50–90% of the longitudinal reaction force on the crankshaft should be offset by the drive counterbalance. Further, the lateral reaction force should preferably be overbalanced by about 170% to about 225%;

that is, the counterbalance should actually increase the force on the drive shaft in the lateral direction, to about 170–225% of the lateral reaction force from the deck.

The counterbalance force needed to substantially cancel out the longitudinal reaction force on the base can be approximated by the formula, $$F = \frac{\text{Swing wt.(lbs.)}}{386.4} \times \text{radius of stroke(in.)} \times \left(\frac{\text{RPM} \times 2\pi}{60}\right)^2$$

RPM refers to the operating speed of the drive, which is preferably about 160–300 rpm, and more preferably about 185–230 rpm, although speeds outside this range are also contemplated. For example, the "Rotex" Series 50 screener made and sold by the assignee of this application, having a single counterbalance drive and a force reducer, has a swung weight of about 2220 pounds. The drive rotates a crank pin in a circle of 3.5 inch at a rate of 200 rpm. A drive counterbalance force of about 4410 lbs. is required to substantially cancel the longitudinal reaction force on the base. For that machine the drive counterbalance should be sized to produce a force of about 50% to about 85% of that amount, i.e., about 2205 to 3749 lbs. The underbalance/overbalance relation of the counterbalance to the longitudinal and lateral forces respectively, alters the movement of the base relative to ground, from what it would have been under conventional practice. If, following past practice, the longitudinal force is fully offset, the base moves only minimally in the longitudinal direction, e.g., 0–0.5 inches.

In accordance with a more preferred embodiment of this invention, the single counterbalance weight should be sized to underbalance the longitudinal reaction force by about 15% to about 30%, and the force absorber should be sized to produce a base lateral movement which is approximately equal to the base longitudinal movement. The movement of the base can be determined by visual observation or by calculation. In the case of a gyratory machine, the base longitudinal movement can be approximated by:

$$\text{Base movement} = \frac{2}{\text{supported wt.}} \times [(\text{swung wt.} \times \text{radius of deck motion}) - (\text{counterbalance wt.} \times \text{counterbalance radius of gyration})]$$

DESCRIPTION OF THE DRAWING

The invention can best be further described by reference to the accompanying drawings, in which.

DETAILED DESCRIPTION

Figure 1:
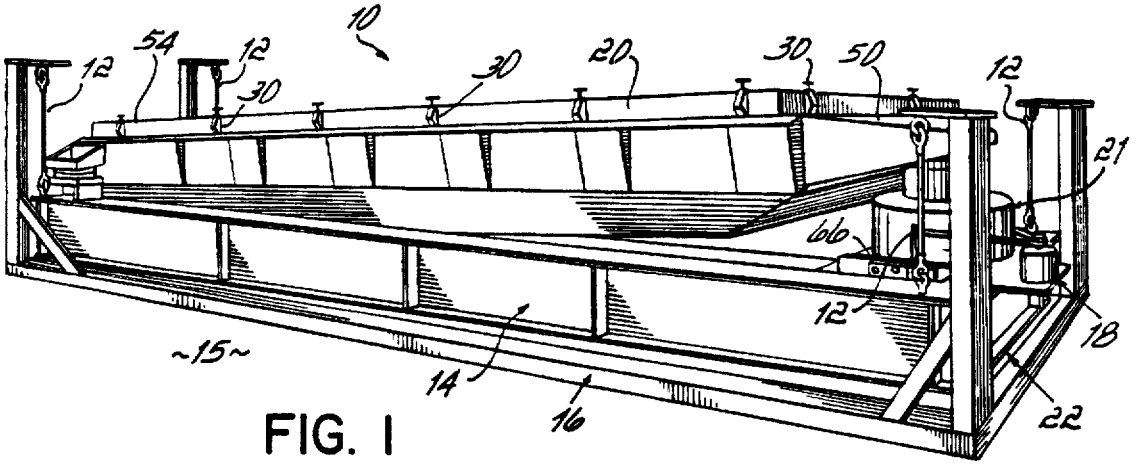
FIG. 1 is a perspective view of a cable hung screener in accordance with a preferred embodiment of the invention.
Figure 2:
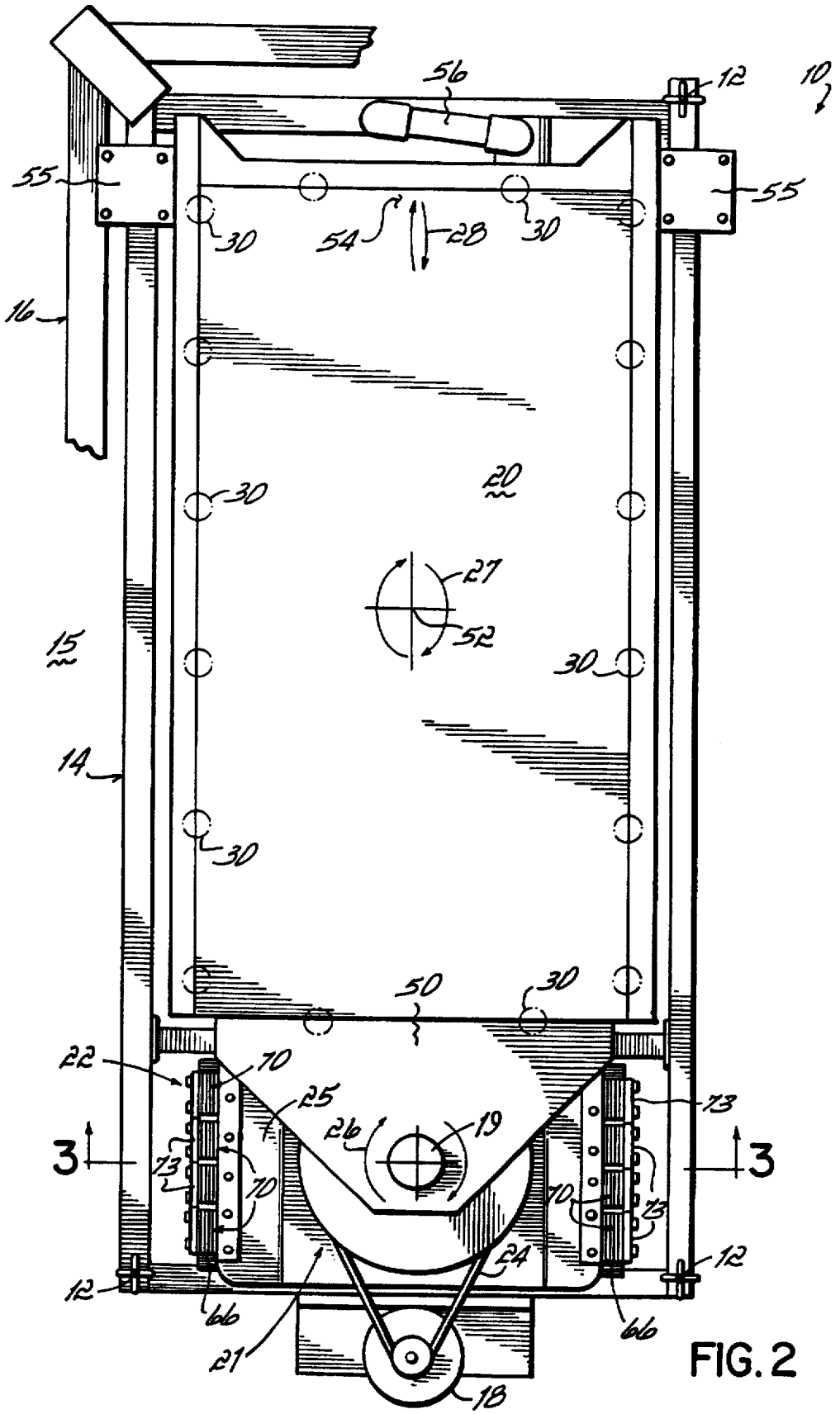
FIG. 2 is a top plan view, partly diagrammatic, of the screener of FIG. 1.

Referring especially to FIGS. 1 and 2 of the drawings, a screening machine 10 has a movable base 14 which is suspended on cables 12 at its four corners from a support or frame 16. Support 16 is fixed with respect to "ground" 15, which may in practice be the floor of a building or other support structure not shown. (Because base 14 is suspended by cables 12 and can move relative to ground 15, it is referred to as a "movable base." In a small machine the base can sometimes alternatively be supported for movement on shear or other supports rather than by cables). One or more removable screens (not shown) are mounted in deck 20 and secured by clamps 30. Screener 10 has a screen deck 20, rectangular in this embodiment, to which a screening motion can be imparted by a drive 21 mounted on base 14. (The deck is sometimes referred to as the screen "box" but can be of a non-rectangular shape, such as circular.) The drive usually includes an electric motor 18 connected by a belt 24 to rotate a drive shaft or crank pin 19 (FIG. 3) which is supported on the base and is journaled to rotate in the head end of deck 20.

In the preferred embodiment, the rotation of crank 19 imparts a type of "gyratory" screening motion to deck 20. The head end 50 of the deck, adjacent crank pin 19, is driven in a circular path 26 relative to base 14, as shown diagrammatically in enlarged form in FIG. 2. The lower or tail end 54 of deck 20 is supported on the base at each corner on a slide plate 55 and may be connected to base 14 through a rocker or drag arm 56. These constraints establish a narrowly elliptical motion of the deck at the tail, as designated by ellipse 28. (As another alternative, the tail 54 of the deck may be supported on leaf springs, not shown. This establishes even more linear motion and eliminates the maintenance associated with slide plates and a drag arm.)

As can be seen in FIG. 2, the motion of points on the screen deck becomes increasingly elliptical from head end 50 to tail end 54. For example, in a "Rotex" Series 50 gyratory screener, the motion of the screen deck at its head end (relative to the base) is a circle 26 of about 3.5 inch diameter (FIG. 2); adjacent center of gravity 52 it is an ellipse 27 still having a major axis of 3.5 inches but a minor axis of 1.75 inch; and at the tail end 54 it is a narrow ellipse 28, again with a major axis of 3.5 inches but a minor axis of only 0.13 inch. The screening motion thus has two components, a longitudinal component parallel to the long axis of the machine, and a lateral component perpendicular to that. The longitudinal motion of deck 20 conveys the particles down the slight inclination from the point of feed toward the tail end, while the gyratory motion screens them. The action of the drive on the deck produces an equal and opposite reaction force on the base (because it is mounted on the base) which tends to move the base forward as the deck is moved rearwardly and tends to move the base to one side as the deck is moved to the other side. The relative movements tend to offset one another.

The screener as thus far described in detail may be of the well-known Rotex type and is therefore not described in further detail.

Eccentric drive 21 (FIG. 2) has a single rotary counterbalance 62. Counterbalance 62 preferably includes a lead slug 63 cast in a cavity in the counterbalance shell 61, and/or a stack of steel plates 64 to bring the total counterbalance weight to approximate a desired value.

In accordance with this invention, counterbalance 62 is weighted to produce a force in the direction of the longitudinal axis of the deck which significantly underbalances (for example by about 15% to 30%) the reaction force that acts on the base in response to operation of drive 21. This degree of unbalance would set up excessive undesirable vibration in a machine without a force reducer. Because the base has different moments of inertia in the longitudinal and lateral directions, the single counterbalance drive moves the base differently in the two directions. A counterbalance weight which substantially underbalances the longitudinal force can substantially overbalance the lateral force. Most preferably the counterbalance weight is selected so that the resulting lateral and longitudinal movements of the base are substantially equal and are both about 0.25 inch. It should be noted that the base movements can be the same in both directions even though the forces which cause those respective movements differ greatly in amount.

Figure 3:
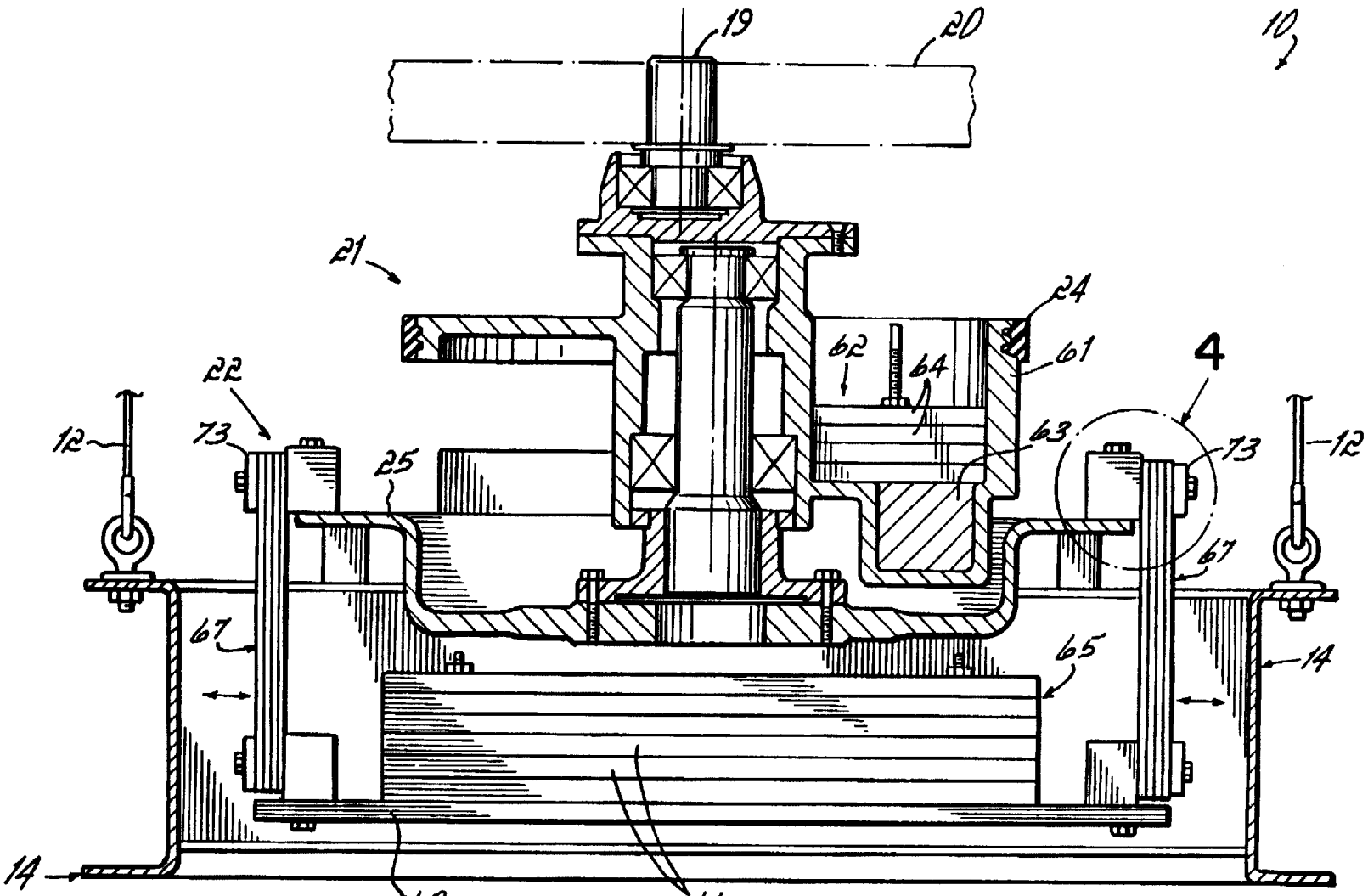
FIG. 3 is an enlarged vertical cross section of the single counterbalance and force absorber, taken along line 3—3 of FIG. 2.

Force reducer 22 may be suspended from the drive mounting 25 on the base, as shown in FIG. 3. It includes a mass (weight) 65 which is mounted by vertical sets of leaf springs 67 for oscillating movement in the lateral direction. Preferably mass 65 is a horizontal stack of individual steel or lead plates 66 which are bolted to a transverse support 68 connected between the lower ends of the springs. The mass can be increased in increments by adding individual plates 66 to the stack. For a Rotex Series 50 machine, for example, it is convenient to use plates each weighing about 230 pounds. As a practical matter the mass need not be sized precisely to a calculated value, but should approximate the calculated desired weight within practical constraints. For a given set of springs having a known spring constant k, the weight of the force reducer can be approximated by the formula:

$$wt.=386.4k/(1.02\times 2\pi f)^2$$

where f is the operating frequency of the drive, preferably about 3.33 hz (200 rpm). The 1.02 factor in this calculation takes into account that the force reducer is preferably tuned to a frequency about 2% above (or more broadly about 101–130% above) the operating frequency of the drive.

Figure 4:
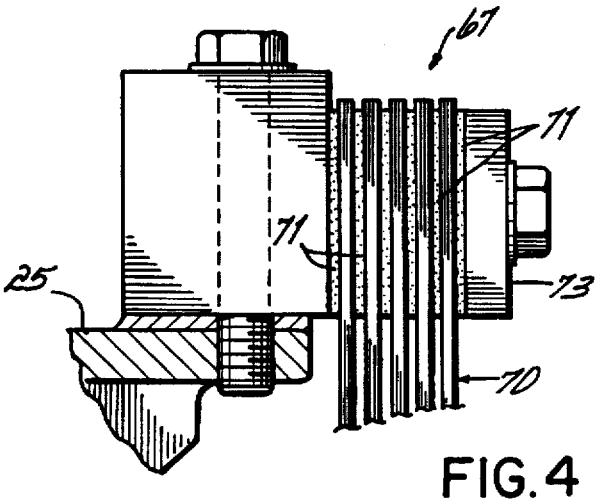
FIG. 4 is an enlarged fragmentary vertical cross-section of one of the sets of springs which support the force reducer mass.
Figure 5:
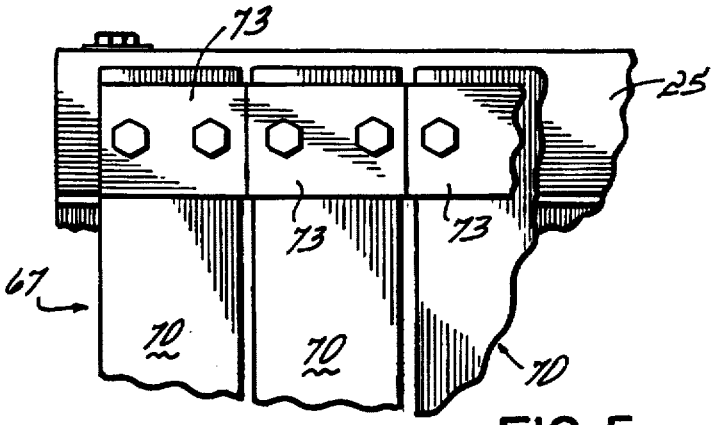
FIG. 5 is an enlarged fragmentary vertical elevation of the spring.

Springs 67 are preferably leaf springs which may be of known fiberglass composition. The presently preferred springs are an oriented fiberglass sheet material known as "Scotchply"™, made by 3M Company, St. Paul, Minn. It is preferable that, rather than using a single stack of large area sheets of fiberglass spring material, the springs are two or more side-by-side stacks 70 of relatively narrow sheets of fiberglass (FIG. 5). The use of springs of smaller face area facilitates spring removal and replacement in the event of fracture or damage, reduces the cost of replacing a single spring sheet, and allows more accurate tuning. Within each stack 70 the individual sheets are separated by spacers 71 at the top and bottom (FIG. 4); flat spring sheets tend to wear undesirably in use during oscillation if they are in face to face engagement. Moreover, sheet springs are not truly flat and may have high spots on which forces may be unduly concentrated if the springs are in facial engagement. Each stack of spring 70 is preferably clamped individually at its upper end to the drive or the base, and at its lower end to mass support 68 (FIG. 6). The use of a separate clamp 73 for each stack 70 of springs permits a given stack to be removed for replacement while the mass remains supported by one or more other spring stacks, so that its weight need not be additionally supported from below. The springs should preferably be as long as possible, with their swing as short as possible; large deflection may lead to cracking.

The force reducer is desirably tuned to operate at a frequency just above the operating frequency of the screener, as taught in the '814 patent, the disclosure of which is incorporated by reference herein. Preferably the reducer is tuned to oscillate at a frequency which is about 101–130% of the operating speed of the drive; the most preferred range is 101–106%. Tuning to a frequency above the drive operating frequency insures that the reducer is not resonated during start-up or in operation: its resonating frequency is approached but not reached. This causes the oscillation of the reducer to be amplified when the reducer is running at its operating speed. Thus the amplitude of reducer lateral movement exceeds that of base 14, and the reaction force of reducer 22 on the base exceeds the force transmitted from the base. The reducer reduces the total force acting on the base by the amount the reducer reaction force exceeds the input force.

EXAMPLES

1. In practice, substantial advantages are obtained by use of the invention. For example, a "Rotex" Series 80 screening machine has a swung weight of about 1577 pounds and a single counterbalance drive which rotates an eccentric pin or shaft in a circle of 1.5 inch radius at a rate of about 218 rpm. In accordance with previous practice the counterbalance was sized to fully counterbalance the reaction force in the longitudinal direction, which used a counterbalance total weight of 498 pounds. The force reducer, tuned to resonate at a frequency of 222 rpm, about 2% above the screener operating frequency of 218 rpm, required a weight of 943 lbs. and 26 spring sheets to oscillate it, 13 sheets at each end. Movement of the base in the longitudinal direction was only about 0.05–0.1", relative to ground. (The movement could have been reduced to virtually zero, but because the individual counterbalance weights were added in standardized increments, 498 pounds was the closest approximation to the calculated weight of 484 lbs. that could be attained without using special weights.) Movement of the base in the lateral direction was 0.3", about 3 times as great as the longitudinal movement. The corresponding force reducer weight was 943 lbs.

A similar machine, fitted with a force reducer in accordance with the principles of this invention, uses a counterbalance weight of 386 lbs. to offset only 77% of the longitudinal reaction force, i.e., an underbalance of 23%. Surprisingly this permits a much greater reduction in force reducer mass, which can be reduced by 45%, to only 521 lbs. Moreover, the mass requires only 14 spring sheets for the desired oscillation, a 47% reduction. This machine has a base motion of about ¼ inch longitudinally and ¼ inch laterally. As a result of the reductions in weight and springs, the cost of the drive assembly (the drive and the force reducer, the springs being typically the most expensive component), is reduced by about 20%, yet screening efficiency is about the same as in the previous machine.

2. As another example, a "Rotex" Series 50 machine having a swung weight of 2220 pounds, when counterbalanced at 100% of theoretical base longitudinal reaction force in accordance with previous practice, required a counterbalance of 513 lbs. and a force absorber mass of 1624 pounds and 29 springs to support it. Base movement was 0.05" longitudinally and 0.25" laterally.

Sized in accordance with this invention, the drive counterbalance and force reducer offset only 77% of the longitudinal reaction force, and the lateral force is overbalanced at 193% of theoretical. The counterbalance weight is reduced to 395 lbs.; the force absorber weight 65 can be reduced to only 1158 pounds (a 29% reduction), and only 21 spring sheets are needed, a 28% reduction. This established longitudinal and lateral base motions both of about 0.25". The invention provides just as good screening efficiency as the previous much heavier force reducer, but substantially reduces weight and cost.

While the invention has been described primarily with a rotary counterbalanced gyratory drive as the preferred embodiment, it should be understood that it can be used in non-gyratory screeners having counterbalanced drives which move the screen along multiple axes.

Having described the invention, what is claimed is:

1. A screening machine comprising a base supported for movement relative to ground, a screen deck movable with respect to the base, a drive mounted on said base, said drive having a single counterbalance and being connected to said deck to impart a screening motion to said deck with components of said screening motion in both longitudinal and lateral directions, such motion of said deck resulting in reaction forces which tend to move said base in both said directions relative to ground, said counterbalance sized to significantly underbalance the reaction force on said base in said longitudinal direction, but to substantially overbalance the reaction force on said base in said lateral direction, and a force reducer for reducing the motion of the base relative to ground, said force reducer comprising a mass supported by springs from said base, said mass being oscillated in said lateral direction upon motion of the base, such oscillation of said mass thereby reducing movement of said base in said lateral direction.

2. A screening machine in accordance with claim 1 wherein said counterbalance is sized to underbalance said reaction force on said base in said longitudinal direction about 10% to about 50%.

3. A screening machine in accordance with claim 2 wherein said counterbalance is sized to underbalance said reaction force on said base in said longitudinal direction by about 10 to 30%.

4. A screening machine in accordance with claim 2 further wherein said counterbalance is sized to overbalance said reaction force on said base in said lateral direction by about 170% to about 225%.

5. A screening machine in accordance with claim 2 wherein said counterbalance, spring and mass are selected so that the movement of said base in said lateral direction when said reducer is oscillating is substantially equal to its movement in said longitudinal direction.

6. A screening machine in accordance with claim 1, wherein said counterbalance, mass and springs are selected so that in operation, the movements of said base in said lateral and longitudinal directions are each less than about 0.5 inch relative to ground.

7. A screening machine in accordance with claim 1 wherein said drive has an operating speed of about 160–300 rpm.

8. A screening machine in accordance with claim 1 wherein said drive has an operating speed of about 185–230 rpm.

9. A screening machine in accordance with claim 1 wherein said reducer is tuned to resonate at a frequency which is in the range of about 101–130% of the operating frequency of said drive.

10. A screening machine in accordance with claim 1 wherein said drive is a gyratory drive.

11. A screening machine in accordance with claim 1 wherein said springs are leaf springs oriented to oscillate in said lateral direction.

12. A screening machine comprising a base supported for movement relative to ground, a screen deck movable with respect to the base, a drive mounted on said base, said drive having a single counterbalance and being connected to said deck to impart a screening motion to said deck with components of said screening motion in both longitudinal and lateral directions, such motion of said deck resulting in reaction forces which tend to move said base in both said directions relative to ground, and a force reducer for reducing the motion of the base relative to ground, said force reducer comprising a mass supported by springs from said base, said mass being oscillated in said lateral direction upon operation of said machine, such oscillation of said mass thereby reducing movement of said base in said lateral direction, said counterbalance, mass and springs being sized so that said base moves approximately equal distances in both said longitudinal and lateral directions, said distances both being less than about 0.5 inch.

* * * * *